US007713029B1

(12) United States Patent
Davies

(10) Patent No.: US 7,713,029 B1
(45) Date of Patent: May 11, 2010

(54) TURBINE BLADE WITH SPAR AND SHELL CONSTRUCTION

(75) Inventor: Daniel O. Davies, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 708 days.

(21) Appl. No.: 11/729,110

(22) Filed: Mar. 28, 2007

(51) Int. Cl.
*F01D 5/14* (2006.01)
*F04D 29/34* (2006.01)

(52) U.S. Cl. ..... 416/219 R; 416/204 R; 416/207

(58) Field of Classification Search ..... 416/204 R, 416/208, 214 A, 217, 219 R
See application file for complete search history.

(56) References Cited

U.S. PATENT DOCUMENTS

| | | | | |
|---|---|---|---|---|
| 2,817,490 | A | | 12/1957 | Broffitt |
| 3,132,841 | A | | 5/1964 | Wilder, Jr. |
| 3,378,228 | A | | 4/1968 | Davies et al. |
| 3,749,518 | A | | 7/1973 | Alver et al. |
| 3,846,041 | A | | 11/1974 | Albani |
| 4,247,259 | A | | 1/1981 | Saboe et al. |
| 4,314,794 | A | | 2/1982 | Holden et al. |
| 4,417,854 | A | * | 11/1983 | Cain et al. ..... 416/241 B |
| 4,473,336 | A | | 9/1984 | Coney et al. |
| 4,512,719 | A | | 4/1985 | Rossmann |
| 4,519,745 | A | | 5/1985 | Rosman et al. |
| 4,563,125 | A | | 1/1986 | Boudigues et al. |
| 4,563,128 | A | | 1/1986 | Rossmann |
| 4,790,721 | A | | 12/1988 | Morris et al. |
| 6,981,847 | B2 | | 1/2006 | Arinci et al. |
| 7,080,971 | B2 | | 7/2006 | Wilson et al. |

* cited by examiner

*Primary Examiner*—Edward Look
*Assistant Examiner*—Dwayne J White
(74) *Attorney, Agent, or Firm*—John Ryznic

(57) ABSTRACT

A turbine blade with a spar and shell construction in which the spar includes a blade tip and a dove-tail on the root end of the spar. A pair of platform halves form a fir-tree attachment capable of sliding into an attachment slot formed within a rotor disk. The platform halves form a slot within the fir-tree configuration that will pinch the dovetail slot of the spar and secure the spar to the platform halves against radial displacement. The shell is secured between the spar tip and the platform of the platform halves when assembled together. The spar includes cooling air passages and impingement cooling holes to provide backside impingement cooling of the shell. A fastener secures the two platform halves together so that the spar and shell blade assembly can slide into the attachment slot within the rotor disk.

11 Claims, 2 Drawing Sheets

Section A-A

Section A-A

Section B-B

TURBINE BLADE WITH SPAR AND SHELL CONSTRUCTION

CROSS-REFERENCE TO RELATED APPLICATIONS

This application is related to U.S. patent application Ser. No. 11/243,308 filed on Oct. 4, 2005 by Wilson et al and entitled TURBINE VANE WITH SPAR AND SHELL CONSTRUCTION.

BACKGROUND OF THE INVENTION

1. Field of the Invention

The present invention relates generally to fluid reaction surfaces, and more specifically to a turbine blade with a spar and shell construction.

2. Description of the Related Art Including Information Disclosed Under 37 CFR 1.97 and 1.98

In a gas turbine engine, such as an aero engine used to power an aircraft or an industrial gas turbine engine used to produce electrical power, a turbine section includes a plurality of stages of rotor blades and stator vanes to extract the energy from the hot gas flow passing through. The engine efficiency can be improved by increasing the temperature of the hot gas flow entering the turbine. However, the inlet temperature is limited to the material properties of the first stage vanes and rotor blades. To improve the efficiency, a complex internal cooling circuits have also been proposed to provide impingement and film cooling to these airfoils in order to allow for a higher gas flow temperature.

A recent improvement in the high temperature resistant airfoils is the use of a spar and shell construction in which a shell having the shape of the airfoil is secured to a spar for support. The shell is typically made from a material that cannot be cast or forged like the nickel based super-alloys used to make turbine blades and vanes. The shell is fabricated from exotic high temperature materials such as Niobium or Molybdenum or their alloys in which the airfoil shape is formed by a well known electric discharge machining process (EDM) or a wire EDM process that can make a thin wall shell suitable for near wall impingement cooling in an airfoil. Because the turbine blade would be under high centrifugal forces during operation, the shell could even be made from a ceramic material because the spar would support the load, allowing for the shell to be exposed to the high temperature gas flow.

Turbine rotor disks also include blade attachment slots in which a root of the turbine blade having a fir-tree configuration is inserted to secure the blade to the rotor disk in the radial direction. The single piece cast nickel super-alloy turbine blade includes the root portion with the fir-tree configuration to fit within the disk slot. There is a need in the prior art for a spar and shell constructed blade to be capable of replacing the nickel super-alloy blade by using the attachment slot within the rotor disk to insert the spar and shell constructed blade.

The Prior Art U.S. Pat. No. 4,790,721 issued to Morris et al on Dec. 13, 1988 and entitled BLADE ASSEMBLY discloses a turbine blade with a metal core having a cap or blade tip, a metal liner functioning as a coolant containing surface, and a ceramic blade jacket secured between the blade tip of the metal core and the platform of the base having the fir-tree configuration. The metal core that holds the ceramic blade jacket (the shell) is secured to the fir-tree base by bonding. This construction is considered to be very weak in holding the blade together during operating speeds producing high centrifugal forces that tend to pull the spar away from the fir-tree root or base. Also, this construction does not permit removal and replacement of the shell component, which is known to be the life limiting part of the spar and shell constructed blade.

It is an object of the present invention to provide for a turbine blade of the spar and shell construction that can be inserted into the dove-tail slot of the rotor disk.

It is another object of the present invention to provide for a turbine blade having a spar and shell construction that can withstand the high centrifugal forces during operation of the engine.

It is another object of the present invention to provide for a turbine blade of the spar and shell construction with a fir-tree root in which the shell can be easily replaced.

BRIEF SUMMARY OF THE INVENTION

The present invention is a turbine blade having a spar and shell construction, in which the spar includes a dove-tail that fits within a two piece platform and root assembly having a fir-tree configuration that slides into a dove-tail slot of the rotor disk. The two piece platform assembly includes the blade platforms to form the gas flow path, and is secured together by a clamping screw or other fastener to facilitate installation of the blade assembly into the rotor disk. The spar and the platform halves each include cooling air passages to supply cooling air to the blade. The spar includes a blade tip, and the shell is compressed between the blade tip of the spar and the platform halves to form the turbine blade. Because of the spar and shell construction, the blade can be made from an exotic high temperature resistant material that cannot be cast or forged into the airfoil shape in order that a higher gas flow temperature can be used in the engine. Also, the blade with the spar and shell construction can be inserted into a dove-tail slot in a rotor disk that is typically is used for a single piece nickel super-alloy turbine blade.

DETAILED DESCRIPTION OF THE INVENTION

Figure 1:
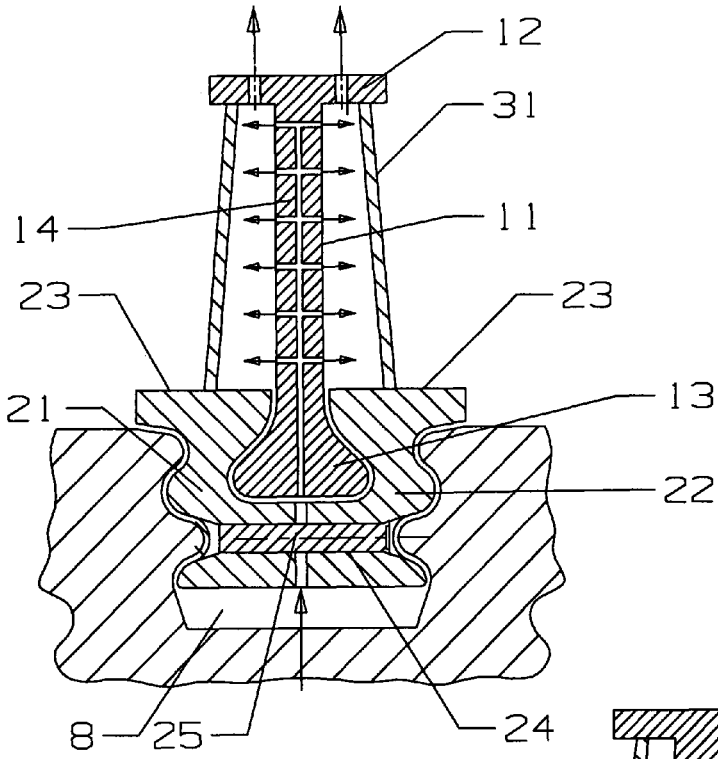
FIG. 1 shows a schematic view of the turbine blade having the spar and shell construction of the present invention.

The present invention is shown schematically in FIG. 1 and is a turbine blade made from a spar and shell construction having a fir-tree root and platform that will slide into an attachment slot of a rotor disk. The turbine blade includes a spar 11 with a blade tip 12 and a dove-tail 13 having a tear-drop shape on the opposite end from the tip. The spar 11 includes one or more cooling air passages 14 to channel cooling air from the root to portions of the blade for cooling. The fir-tree root and platform of the blade assembly includes two platform halves 21 and 22 that, when combined, form a fir-tree configuration that can slide within the attachment slot formed in the rotor disk. Each platform halve 21 and 22 includes a slot 26 that, when joined together, form a slot that can secure the dove-tail 13 of the spar 11 to the platform halves. The spar dove-tail and the platform halves slots 26 are of such size and shape to secure the spar 11 to the dove-tail configuration of the platform halves against radial displacement from high rotational speeds of the rotor disk. The platform halves 21 and 22 pinch the dove-tail 13 of the spar 11 to secure the spar 11 against radial displacement during engine operation. A hole 24 is formed in the two platform halves 21 and 22 to receive a screw 25 or rivet (or other well known fastener) in order to secure the two platform halves together. The platform halves 21 and 22 also include one or more cooling air passages to connect the cooling air source to the cooling air passages 14 within the spar 11.

Although not shown in the Figures, the spar can have radial or serpentine flow cooling channels connected to impingement cooling holes to direct jets of impingement cooling air onto the backside surface of the shell 31 in order to provide impingement cooling for the shell and spar. Also, cooling holes could be used on the blade tip 12 of the spar 11 to provide cooling for the blade tip 12.

Figure 2:
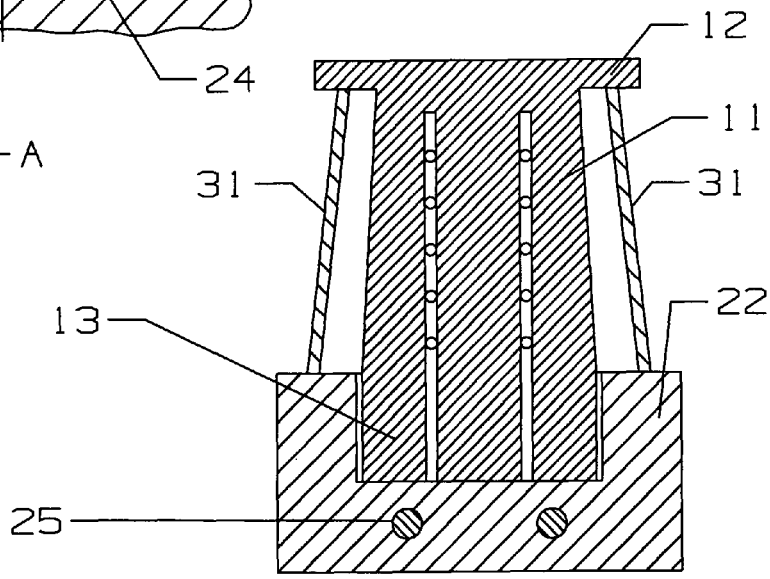
FIG. 2 shows a cross section of a front view of the turbine blade of FIG. 1.
Figure 3:
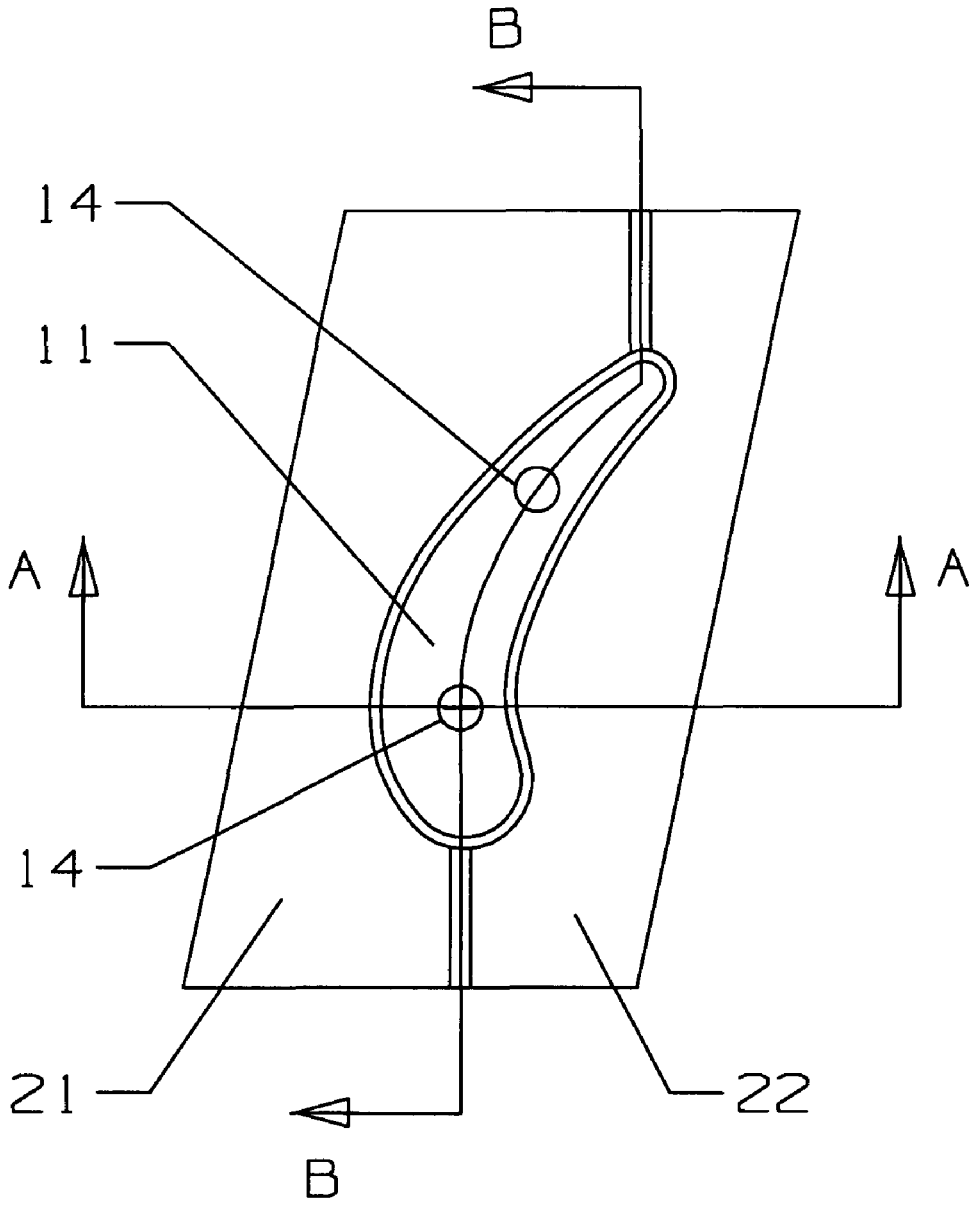
FIG. 3 shows a side view of a cross section of the turbine blade of FIG. 1.

The shell 31 is a thin wall airfoil surface that can be made from a high temperature resistant refractory or exotic material such as Niobium or Molybdenum that cannot be cast or forged, but must be formed from one of the well known processes such as electric discharge machining (EDM) or wire EDM that can form the thin walled shell without having to cast or forge the shell. The spar and shell construction of the present invention can also be used with shells made from machined or cast pieces as well. FIG. 2 shows a front view of a cross section of the blade with the spar and shell construction of FIG. 1. FIG. 3 shows a side view of a cross section of the blade of FIG. 1. The shell 31 is secured between the blade tip 12 of the spar 11 and the platforms 23 of the two platform halves 21 and 22. Because the spar 11 includes the dove-tail 13 that is pinched between the platform halves 21 and 22, the blade assembly can operate at very high rotational speeds without the spar 11 breaking away from the rotor disk and the shell coming off. Also, the turbine blade of the present invention can be used to replace a prior art nickel super-alloy single piece turbine blade in which the root with the fir-tree attachment is formed as a single piece with the airfoil portion. When the spar is inserted into the shell and the two platform halves are fastened together, the platform halves will not quite come together in their operational position because the shell must be compressed between the tip and the platforms. Because of the dove-tail in the spar and the slot in the platform halves having the configuration and shape as shown in the Figures, when the fastener is tightened and the two platform halves 21 and 22 come together, a compression of the shell between the spar tip and the platform surfaces is produced.

To cool the blade, the spar blade tip 12 includes cooling holes 12 to provide cooling for the tip 12. the cooling air passing through the impingement cooling holes in the main body of the spar 11 will pass in the space between the spar and the shell and then up through the tip cooling holes 12 as seen by the arrows in FIG. 2. Two fastener screws are shown to secure the platform halves together. However, the number of fasteners and the kind used can vary depending upon the size of the blade or other factors such as reliability concerns. The platform and the blade tip can include a groove to fit the end of the shell within when the blade assembly is fastened together. Ribs extending from the spar can also be used to secure the shell against deflections during operation and add rigidity to the shell.

I claim:

1. A turbine blade for use in a gas turbine engine comprising:

a spar having a root end and a tip end, the spar having a blade tip on the tip end and a dove-tail on the root end;

a pair of platform halves forming a fir-tree configuration capable of sliding into a slot of a rotor disk, the platform halves also forming a slot in which the dove-tail of the spar is secured against radial displacement; and, a shell having an airfoil shape and being secured between the blade tip of the spar and the platforms of the platform halves.

2. The turbine blade of claim 1, and further comprising:

the spar includes a cooling air passage and impingement cooling holes to direct jets of impingement cooling air onto the backside of the shell to provide cooling.

3. The turbine blade of claim 2, and further comprising:

the spar includes tip cooling holes to discharge cooling air from a space formed between the spar and the shell out from the blade tip.

4. The turbine blade of claim 1, and further comprising:

the platform halves include a fastener means to secure the two halves together and pinch the dove-tail of the spar within the platform halves.

5. The turbine blade of claim 4, and further comprising:

the spar dove-tail and the slot in the platform halves are shaped such that the shell will be compressed between the spar tip and the platform when the platform halves are fastened together.

6. The turbine blade of claim 1, and further comprising:

the platform halves for a blade platform surface for the hot gas flow around the blade.

7. The turbine blade of claim 1, and further comprising:

the shell is a single piece and forms the entire airfoil surface on the pressure and the suction sides and the leading and the trailing edges of the blade except for the blade tip.

8. The turbine blade of claim 7, and further comprising:

the shell is formed from an electric discharge machining process.

9. The turbine blade of claim 8, and further comprising:

the shell is made substantially from Niobium, Molybdenum, or their alloys.

10. The turbine blade of claim 7, and further comprising:

the shell is formed from an investment casting process.

11. The turbine blade of claim 7, and further comprising:

the shell is formed from a ceramic material.

* * * * *